US010287081B2

(12) United States Patent
Stever

(10) Patent No.: US 10,287,081 B2
(45) **Date of Patent: *May 14, 2019**

(54) ASEPTIC PACKAGE FLUID DISPENSING APPARATUS

(71) Applicant: Fres-co System USA, Inc., Telford, PA (US)

(72) Inventor: Raymond Andrew Stever, Reading, PA (US)

(73) Assignee: Fres-co System USA, Inc., Telford, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/782,262

(22) Filed: Oct. 12, 2017

(65) Prior Publication Data

US 2018/0029774 A1 Feb. 1, 2018

Related U.S. Application Data

(63) Continuation-in-part of application No. 15/250,252, filed on Aug. 29, 2016.
(Continued)

(51) Int. Cl.
*B65D 47/06* (2006.01)
*B65D 75/70* (2006.01)
(Continued)

(52) U.S. Cl.
CPC ..... *B65D 75/70* (2013.01); *B65D 25/48* (2013.01); *B65D 37/00* (2013.01); *B65D 47/06* (2013.01);
(Continued)

(58) Field of Classification Search
CPC ..... B65D 5/747; B65D 5/748; B65D 17/06; B65D 41/20; B65D 41/205; B65D 41/50; B65D 41/505; B65D 47/36; B65D 47/38; B65D 51/002; B65D 51/20; B65D 51/22; B65D 51/221; B65D 51/222;
(Continued)

(56) References Cited

U.S. PATENT DOCUMENTS 2,895,643 A 7/1959 Fladung
3,239,104 A 3/1966 Scholle
(Continued)

FOREIGN PATENT DOCUMENTS

EP 2277821 A1 1/2011
GB 2082152 A 3/1982

OTHER PUBLICATIONS

International Search Report for PCT/US2017/052443 dated Nov. 23, 2017.

*Primary Examiner* — Patrick M. Buechner
(74) *Attorney, Agent, or Firm* — Caesar Rivise, PC

(57) ABSTRACT

A flexible package for dispensing a liquid. The package includes a fitment and a piercing member. The fitment is secured to a wall of the flexible package and has a passageway extending through it and a screw-thread section. The piercing member has a passageway extending through it, a piercing tip, and a screw-thread section. The piercing member is configured for insertion in the passageway of the fitment, with the screw-thread sections engaging each other to cause the piercing tip to penetrate the package, whereupon the liquid within the package can flow into and through the piercing member.

20 Claims, 7 Drawing Sheets

Related U.S. Application Data

(60) Provisional application No. 62/213,932, filed on Sep. 3, 2015.

(51) Int. Cl.
*B65D 75/58* (2006.01)
*B65D 77/06* (2006.01)
*B65D 37/00* (2006.01)
*B65D 25/48* (2006.01)

(52) U.S. Cl.
CPC ..... *B65D 75/5861* (2013.01); *B65D 77/068* (2013.01); *B65D 2547/066* (2013.01)

(58) Field of Classification Search
CPC .. B65D 51/225; B65D 51/226; B65D 51/227; B65D 77/067; B65D 47/06; B65D 37/00; B65D 77/068; B65D 2547/066; B67D 7/24; B67D 7/26
USPC ..... 277/615
See application file for complete search history.

(56) References Cited

U.S. PATENT DOCUMENTS 3,573,871 A 4/1971 Warner
3,696,969 A 10/1972 De Van et al.
3,811,711 A 5/1974 Tarkenton
3,829,107 A 8/1974 Machado et al.
4,214,675 A 7/1980 Schmit
4,257,535 A 3/1981 Mellett
4,303,103 A 12/1981 Marks et al.
4,304,415 A 12/1981 Wolf et al.
4,314,654 A 2/1982 Gaubert
4,322,018 A 3/1982 Rutter
4,416,395 A 11/1983 Gaubert
4,429,810 A 2/1984 Hampel et al.
4,440,316 A 4/1984 Christine
4,452,378 A 6/1984 Christine
4,475,670 A 10/1984 Rutter
4,565,381 A 1/1986 Joelson
4,602,725 A 7/1986 Malpas et al.
4,619,377 A 10/1986 Roos
4,624,392 A 11/1986 Malpas et al.
4,884,705 A * 12/1989 Debetencourt ..... B65D 47/242 215/250
5,111,970 A 5/1992 Rutter et al.
5,141,133 A * 8/1992 Ninomiya ..... B65D 5/748 222/541.2
5,147,070 A * 9/1992 Iwamoto ..... B65D 5/748 222/541.2
5,169,161 A 12/1992 Jones
5,297,696 A * 3/1994 Bernstein ..... B67B 7/26 222/83
5,325,983 A * 7/1994 Imai ..... B65D 5/748 220/277
5,337,775 A 8/1994 Lane et al.
5,482,076 A 1/1996 Taylor et al.
5,482,176 A * 1/1996 Maietta ..... B65D 5/748 215/220
5,497,909 A 3/1996 Wirsig et al.
5,947,318 A * 9/1999 Palm ..... B65D 5/746 220/278
6,131,767 A 10/2000 Savage et al.
6,279,779 B1 * 8/2001 Laciacera ..... B65D 5/748 222/541.2
6,343,412 B1 2/2002 Stephenson
6,354,466 B1 3/2002 Karpisek
6,364,164 B1 4/2002 Troiano
6,378,730 B1 4/2002 Reddy et al.
6,398,075 B1 6/2002 Laciacera et al.
6,422,412 B1 * 7/2002 Sagawa ..... B65D 5/748 220/277
6,446,845 B1 9/2002 Steiger
7,188,749 B2 3/2007 Miller et al.
7,303,713 B2 12/2007 Gabriel et al.
D582,788 S 12/2008 Smith
7,484,641 B2 * 2/2009 Casale ..... B65D 5/748 220/278
7,559,432 B2 7/2009 Mavin et al.
7,708,164 B2 5/2010 Pritchard
7,789,269 B2 9/2010 Pritchard
8,070,014 B2 12/2011 Wisniewski
8,353,428 B2 1/2013 Pritchard
8,695,851 B2 4/2014 Pritchard
8,733,600 B2 5/2014 Pritchard
8,967,430 B2 3/2015 Wrigley
2004/0104245 A1 * 6/2004 Dubach ..... B65D 5/748 222/83
2006/0261028 A1 * 11/2006 Dubach ..... B65D 5/748 215/257
2007/0187428 A1 * 8/2007 Dzabrailova ..... B65D 5/748 222/83
2007/0289937 A1 * 12/2007 Kaneko ..... B65D 5/748 215/252
2008/0029540 A1 2/2008 Johnson
2008/0179331 A1 * 7/2008 Sharp ..... B65D 51/2835 220/521
2008/0210745 A1 * 9/2008 Rigling ..... B65D 5/748 229/125.04
2008/0245816 A1 10/2008 Armstrong et al.
2010/0200611 A1 8/2010 Pritchard
2010/0264146 A1 * 10/2010 Casale ..... B65D 5/029 220/278
2012/0138634 A1 6/2012 Benko et al.
2012/0241471 A1 * 9/2012 Barron ..... B65D 5/748 222/83
2012/0267393 A1 10/2012 Pritchard et al.
2013/0168412 A1 * 7/2013 Barron ..... B65D 51/221 222/83
2013/0270293 A1 10/2013 Dresser
2014/0048557 A1 2/2014 Barron
2014/0151374 A1 * 6/2014 Barron ..... B65D 5/747 220/277
2014/0197199 A1 7/2014 Barron
2015/0175323 A1 * 6/2015 Barron ..... B65D 5/748 222/81
2015/0259105 A1 9/2015 Martinez
2016/0207684 A1 * 7/2016 Johnson ..... B65D 75/5877
2016/0229582 A1 * 8/2016 Dill ..... B65D 5/748

* cited by examiner

Fig. 6
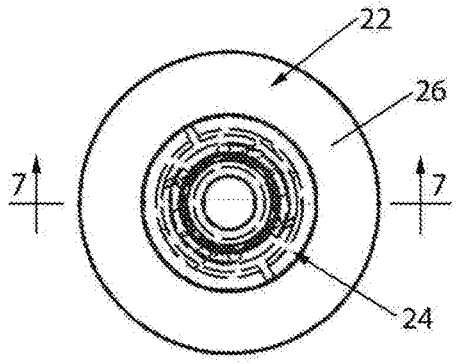
Fig. 7
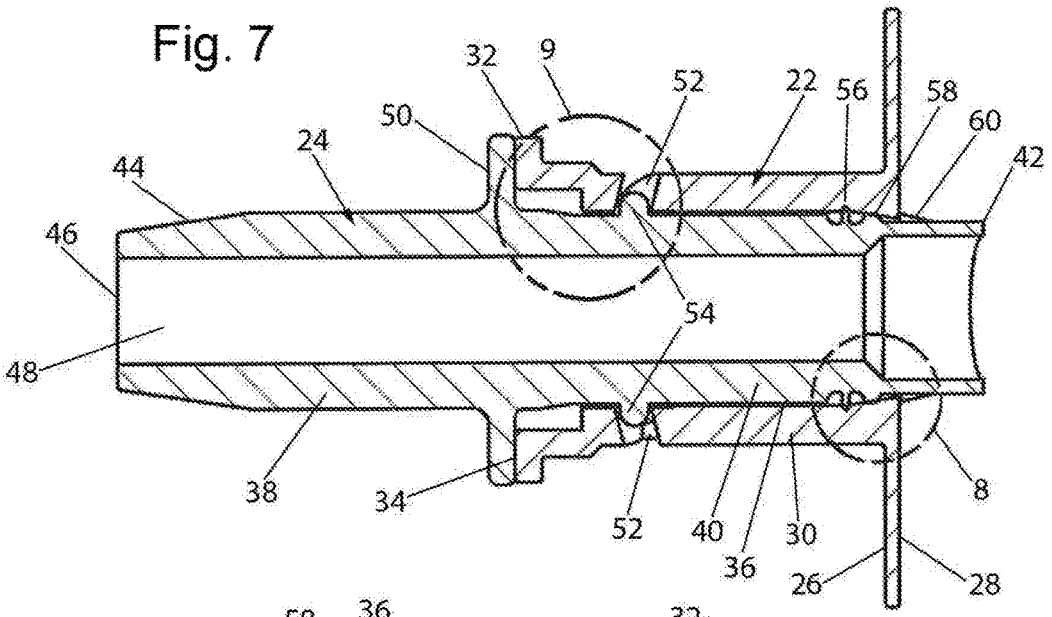
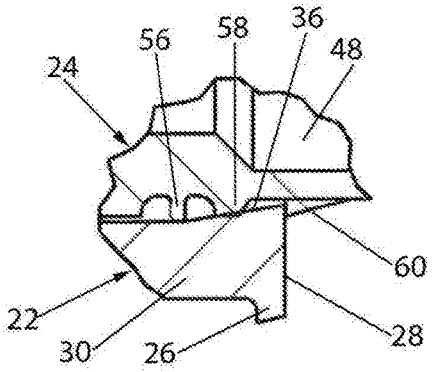
Fig. 8
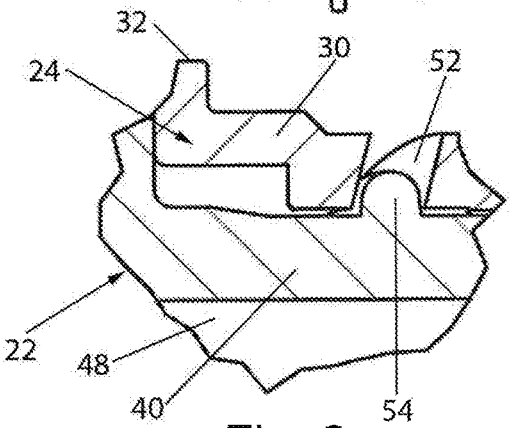
Fig. 9

Fig. 13A
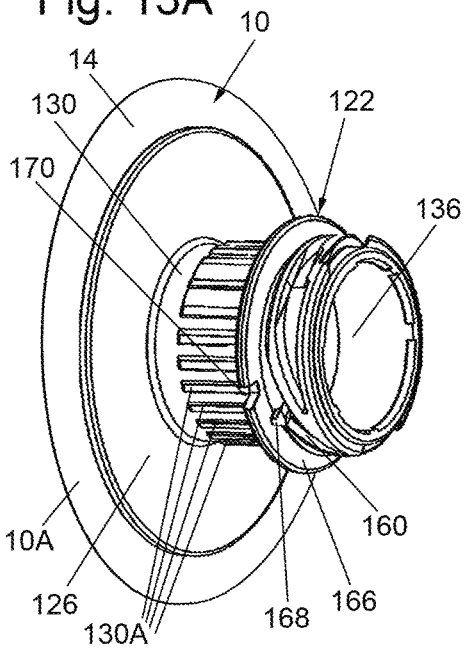
Fig. 13B
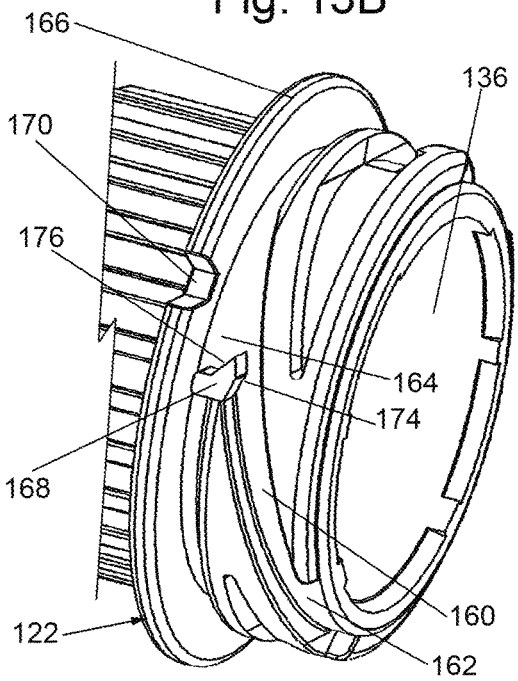
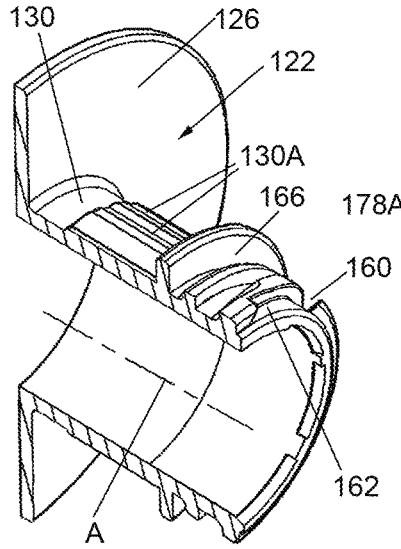
Fig. 14
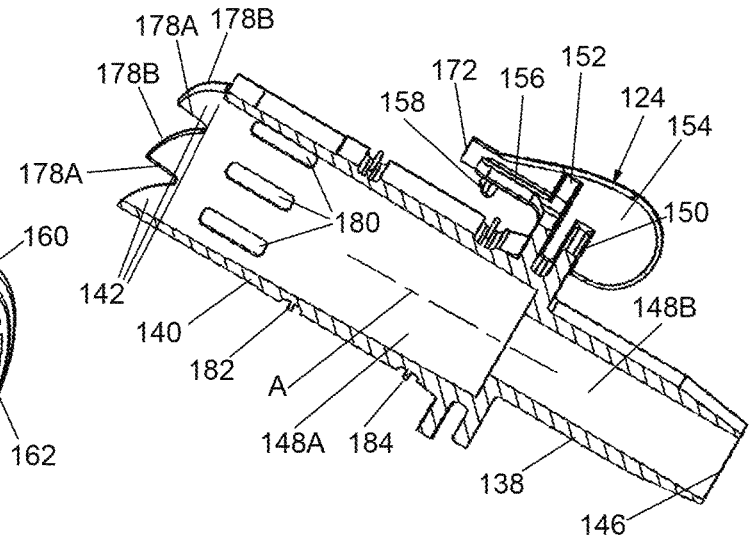
Fig. 15

ASEPTIC PACKAGE FLUID DISPENSING APPARATUS

CROSS-REFERENCE TO RELATED APPLICATIONS

This application is a Continuation-In-Part of U.S. application Ser. No. 15/250,252, filed on Aug. 29, 2016, entitled Aseptic Package Fluid Dispensing Apparatus And Methods Of Dispensing Liquids From Flexible Packages, which in turn claims the benefit under 35 U.S.C. § 119(e) of Provisional Application Ser. No. 62/213,932 filed on Sep. 3, 2015, entitled Aseptic Package Fluid Dispensing Apparatus and Methods Of Dispensing A Liquid From A Flexible Package, both of which prior applications are assigned to the same assignee as this invention and the entire disclosures of which are hereby incorporated by reference herein.

BACKGROUND OF THE INVENTION

Field of Invention

This invention relates generally to flexible packages and more particularly to apparatus in the form of a fitment for mounting on a flexible package holding a liquid and an associated piercer for insertion into the fitment to dispense liquid from the package and to methods for dispensing a liquid from a flexible package.

Description of Related Art

Various flexible packages, for dispensing bulk liquids are commercially available. Such packages are typically in the form of a flexible bag in which the liquid to be dispensed is located and a fitment mounted on the bag and which is arranged to receive a piercing member. Typically the fitment is mounted on the bag by means of a flange. The piercing member serves to pierce the wall of the bag on which the fitment is mounted to provide access to the liquid within the bag so that it can be dispensed therefrom. External attachment of the fitment's flange to the flexible bag permits the storage of liquids in air-tight and even sterile condition within the bag through means of high production capacity heat sealing equipment until, and possibly even after, such time as the liquid is dispensed. Other embodiments of dispensing apparatus have been long used for other functions. "Push to activate" and "twist to activate" dispensing apparatus that pierce a flexible or semi-rigid container are well known.

The patent literature includes various examples of flexible packages making use of fitments and piercing members received in the fitments to pierce the bag to dispense its liquid contents. See for example, U.S. Pat. No. 3,239.104 (Scholle); U.S. Pat. No. 4,322,018 (Rutter); U.S. Pat. No. 4,214,675 (Schmit); U.S. Pat. No. 5,497,909 (Wirsig et al.); U.S. Pat. No. 7,559,432 (Mavin et al.); U.S. Pat. No. 8,070,014 (Wisniewski et al.); and U.S. Pat. No. 8,733,600 (Pritchard).

While the aforementioned packages with fitments may be generally suitable for their intended purposes, they suffer from one or more drawbacks, e.g., simplicity of construction, cost, ease of use, etc. The subject invention addresses the needs of the prior art.

SUMMARY OF THE INVENTION

One aspect of this invention is apparatus for dispensing a liquid from within a flexible package. The apparatus comprises a fitment and a piercing member. The fitment comprises a body having a passageway extending therethrough, and a flange. The passageway has a central longitudinal axis. The flange is configured for securement to a wall of the flexible package, whereupon a portion of the wall of the flexible package is located within the passageway. The piercing member comprises a distally located section, a proximally located section, and a passageway extending through the distally located section and the proximally located section. The piercing member has a piercing tip configured to be rotated in a first rotation direction about the central longitudinal axis. The piercing tip comprises a leading tooth and a plurality of trailing teeth. The leading tooth is configured for less aggressive cutting than the plurality of trailing teeth. The leading tooth is configured to engage a portion of the wall of the package upon rotation of the piercing member about the central longitudinal axis in the first rotational direction to cut and pierce therethrough at the same time that the plurality of trailing teeth engage respective portions of the wall of the package to cut and pierce therethrough, whereupon the piercing tip penetrates through the wall of the package to enable the liquid within the package to flow into and through the passageway of the piercing member.

In accordance with one preferred aspect of the apparatus of this invention, the plurality of trailing teeth comprise a series of a first trailing tooth and a last trailing tooth, and wherein the piercing tip additionally comprises a gap between the leading tooth and the last trailing tooth, whereupon when the piercing member penetrates the wall of the package it creates a flap which remains connected to the wall of the package.

In accordance with another preferred aspect of the apparatus of this invention, each of the plurality of trailing teeth is of identical construction.

In accordance with another preferred aspect of the apparatus of this invention, the leading tooth includes a piercing point, and wherein each of the trailing teeth is serrated and comprises a series of a first piercing point, a second piercing point and a third piercing point, wherein the second piercing point is located between the first and third piercing points, and wherein all of the piercing points are of the same height.

In accordance with another preferred aspect of the apparatus of this invention, the leading tooth includes a generally linear shallow angle leading edge and a convex arcuate trailing edge, and wherein the piercing point of the leading tooth is located between the concave arcuate leading edge and the convex arcuate trailing edge.

In accordance with another preferred aspect of the apparatus of this invention, each of the trailing teeth comprises a generally linear steep angle leading edge and an elongated arcuate trailing edge.

In accordance with another preferred aspect of the apparatus of this invention, the piercing tip has a predetermined periphery, and wherein each of the teeth extends for a respective portion of the predetermined periphery, each of the respective portions being the same.

In accordance with another preferred aspect of the apparatus of this invention, the plurality of trailing teeth consists of four trailing teeth and wherein the gap extends for approximately 70 degrees along the predetermined periphery measured about the central longitudinal axis.

In accordance with another preferred aspect of the apparatus of this invention, when the piercing member is located within the passageway of the fitment an interface is created therebetween and wherein the apparatus additionally comprises a first sealing member and a second sealing member for sealing the interface.

In accordance with another preferred aspect of the apparatus of this invention, the first sealing member is configured to form the compression seal before the piercing tip penetrates the wall of the package and the second sealing member is configured to form a compression seal in the interface after the piercing tip has penetrated the wall of the package.

Another aspect of this invention is a flexible package configured for dispensing a liquid therefrom. The flexible package comprises a hollow member having a wall formed of a flexible material and a dispensing apparatus for dispensing a liquid from within the flexible package. The dispensing apparatus comprises a fitment and a piercing member. The fitment comprises a body having a passageway extending therethrough, and a flange. The passageway has a central longitudinal axis. The flange is configured for securement to a wall of the flexible package, whereupon a portion of the wall of the flexible package is located within the passageway. The piercing member comprises a distally located section, a proximally located section, and a passageway extending through the distally located section and the proximally located section. The piercing member has a piercing tip configured to be rotated in a first rotation direction about the central longitudinal axis. The piercing tip comprises a leading tooth and a plurality of trailing teeth. The leading tooth is configured for less aggressive cutting than the plurality of trailing teeth. The leading tooth is configured to engage a portion of the wall of the package upon rotation of the piercing member about the central longitudinal axis in the first rotational direction to cut and pierce therethrough at the same time that the plurality of trailing teeth engage respective portions of the wall of the package to cut and pierce therethrough, whereupon the piercing tip penetrates through the wall of the package to enable the liquid within the package to flow into and through the passageway of the piercing member.

In accordance with one preferred aspect of the flexible package of this invention, the plurality of trailing teeth comprise a series of a first trailing tooth and a last trailing tooth, and wherein the piercing tip additionally comprises a gap between the leading tooth and the last trailing tooth, whereupon when the piercing member penetrates the wall of the package it creates a flap which remains connected to the wall of the package.

In accordance with another preferred aspect of the flexible package of this invention, each of the plurality of trailing teeth is of identical construction.

In accordance with another preferred aspect of the flexible package of this invention, the leading tooth includes a piercing point, and wherein each of the trailing teeth is serrated and comprises a series of a first piercing point, a second piercing point and a third piercing point, wherein the second piercing point is located between the first and third piercing points, and wherein all of the piercing points are of the same height.

In accordance with another preferred aspect of the flexible package of this invention, the leading tooth includes a generally linear shallow angle leading edge and a convex arcuate trailing edge, and wherein the piercing point of the leading tooth is located between the concave arcuate leading edge and the convex arcuate trailing edge.

In accordance with another preferred aspect of the flexible package of this invention, each of the trailing teeth comprises a generally linear steep angle leading edge and an elongated arcuate trailing edge.

In accordance with another preferred aspect of the flexible package of this invention, the piercing tip has a predetermined periphery, and wherein each of the teeth extends for a respective portion of the predetermined periphery, each of the respective portions being the same.

In accordance with another preferred aspect of the flexible package of this invention, the plurality of trailing teeth consists of four trailing teeth and wherein the gap extends for approximately 70 degrees along the predetermined periphery measured about the central longitudinal axis.

In accordance with another preferred aspect of the flexible package of this invention, when the piercing member is located within the passageway of the fitment an interface is created therebetween and wherein the apparatus additionally comprises a first sealing member and a second sealing member for sealing the interface.

In accordance with another preferred aspect of the flexible package of this invention, the first sealing member is configured to form the compression seal before the piercing tip penetrates the wall of the package and the second sealing member is configured to form a compression seal in the interface after the piercing tip has penetrated the wall of the package.

DESCRIPTION OF THE DRAWING

The invention will be described in conjunction with the following drawings in which like reference numerals designate like elements and wherein:

FIG. 6 is a front elevation view of the piercing member within the fitment;

FIG. 7 is an enlarged sectional view taken along line 7-7 of FIG. 6;

FIG. 8 is an enlarged sectional view of the portion of the structure shown within the area designated by the broken circle 8 in FIG. 7;

FIG. 9 is an enlarged sectional view of the portion of the structure shown within the area designated by the broken circle 9 in FIG. 7;

FIG. 13A is an isometric view of the fitment of FIG. 10 mounted on a flexible package, but with the protective cover of the fitment removed so that the fitment is ready to receive the piercing member;

FIG. 13B is an enlarged isometric view of the distal portion of the fitment shown in FIG. 13A;

FIG. 14 is a longitudinal sectional view of the fitment shown in FIG. 13A;

FIG. 15 is a longitudinal sectional view of the piercing member shown in FIG. 10;

DETAILED DESCRIPTION OF THE PREFERRED EMBODIMENT

Figure 1:
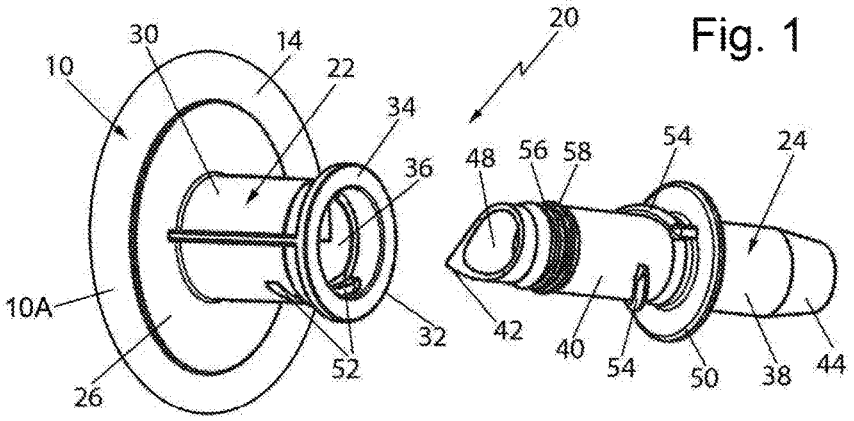
FIG. 1 is an exploded isometric view of one exemplary apparatus including a fitment and a piercing member, constructed in accordance with this invention for mounting on a flexible package having a liquid therein to dispense the liquid from the package.
Figure 2:
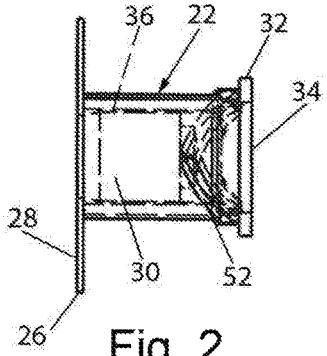
FIG. 2 is a side elevation view of the fitment shown in FIG. 1.
Figure 3:
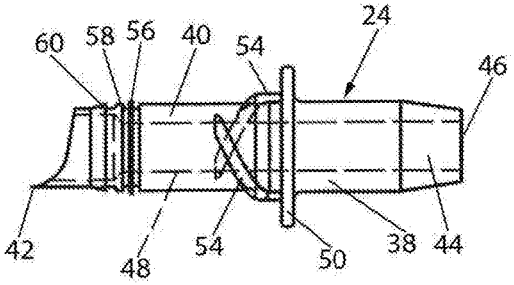
FIG. 3 is a side elevation view of the piercing member shown in FIG. 1.
Figure 4:
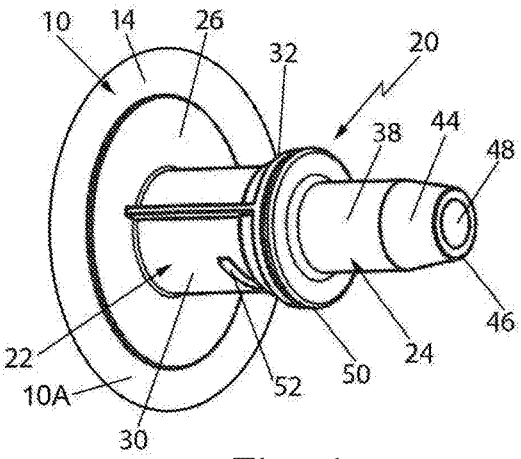
FIG. 4 is an isometric view showing the piercing member inserted within the fitment.
Figure 5:
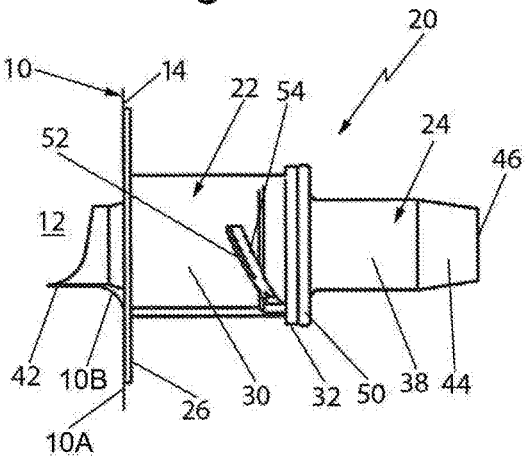
FIG. 5 is a side elevation view of structure shown in FIG. 4.

Referring now to the various figures of the drawing wherein like reference characters refer to like parts, there is shown in FIG. 1 one exemplary embodiment of a package 10 making use of a dispensing apparatus 20 constructed in accordance with this invention. The package is arranged for holding a liquid, aseptically packaged or otherwise, within it and for dispensing that liquid by means of the dispensing apparatus 20. The apparatus 20 basically comprises a fitment 22 and a piercing member 24. In the exemplary embodiment shown the package 10 is in the form of a bag or pouch formed of flexible sheet material defining plural walls, only one of which 10A is shown. The walls bound a hollow interior 12 (FIG. 5) in which the liquid to be dispensed is located. The bag or pouch can be of any conventional construction, e.g., it may be formed of a polymeric film of one or more layers. The fitment 20 is fixedly mounted, e.g., welded, on an exterior surface 14 of a portion of one of the walls making up the bag or pouch. In this case the fitment is fixedly mounted on the front wall 10A of the bag or pouch 10.

The fitment 20 basically comprises a body that is a molded, hollow component formed of any suitable material, e.g., a plastic. In one exemplary preferred embodiment of this invention the fitment is an injection molded plastic member made of a single thermoplastic polymer, such as polyethylene, that is able to be heat welded or ultrasonically welded to a flexible bag or container. The body includes a planar flange 26 having a planar rear surface 28 (FIG. 7) that is configured to be fixedly secured, e.g., welded, to the outer surface 14 of a portion of the wall 10A of the bag 10. The portion of the body contiguous with the flange 26 is in the form of a collar 30, the distal end of which includes a relatively short annular flange 32 having a planar front end surface 34. A central passageway 36 extends through the collar from the front end surface 34 of the flange 32 to the rear surface 28 of the flange 26. Thus, when the fitment 22 is secured to the wall 10A of the bag 10 a portion of that wall is in communication with the passageway 36. That portion of the wall 10A forms a frangible penetration zone 10B (FIG. 5) in the bag (i.e., the portion of the wall of the bag that will be penetrated by the piercing member 24, as will be described later). As best seen in FIG. 8, the inner surface of the central passageway 36 tapers slightly inward immediately adjacent the rear surface 28 of the fitment for reasons to be discussed later.

The details of the construction and operation of the piercing member 24 will be described shortly. Suffice it for now to state that the piercing member is arranged to be received within the central passageway 36 of the fitment and moved to an extended or deployed position wherein a sharp tip portion of the piercing member passes through the frangible zone of the bag's wall to pierce that wall portion such that the tip and a contiguous portion of the piercing member will be located within the interior of the bag. Once the piercing tip portion is within the bag, the liquid contents can flow out through the piercing member.

The piercing member basically comprises a tubular member having a proximally located section 38 and a distally located section 40. The distal end of the distally located section 40 is in the form of a sharpened piercing tip 42. The proximal end portion of the proximally located section 38 has a tapering sidewall 44 terminating at a generally planar proximal end face 46. The tapering sidewall 44 is provided to enable a dispensing tube (not shown) to be connected to it. The dispensing tube can form some portion of a dispensing device or can serve as the input to a receptacle or storage container into which the liquid from the bag 10 will flow when the piercing member is fully deployed, as will be described later.

A central passageway 48 (FIG. 7) extends the length of the piercing member from its distally located end face 46 to its piercing tip 42. The internal diameter of the passageway 48 can be of any suitable size, for a desired flow rate. For example, for a relatively low flow rate the internal diameter of the passageway can be 0.390 inch. An annular flange 50 projects outward from the body of the piercing member 24 between the proximally located section 38 and the distally located section 40. In accordance with one preferred exemplary embodiment of this invention the piercing member is an integral unit molded of the same material as that making up the fitment.

As mentioned above the piercing member 24 is configured to be inserted into the central passageway 36 of the fitment 22 and moved therealong so that its piercing tip 42 penetrates the frangible zone of the wall of the bag 10 on which the fitment is mounted. In accordance with one preferred aspect of this invention the piercing member is configured to be screwed into, e.g., threadedly engage, the fitment to provide a mechanical advantage in the deployment and piercing of the wall of the bag. In particular, a helical or spiral slot section 52 is provided in the collar 30 adjacent the flange 32. The helical slot section forms a section of a screw-thread which is configured to receive a mating section of a screw-thread 54 on the piercing member so that the piercing member can be screwed into the central passageway. The screw thread 54 is located on the outer surface of the distally located section 40. Thus, when the distally located section of the piercing member is inserted into the passageway 36 of the fitment the male screw-thread 54 of the piercing member will engage and slide along the female screw-thread 52 of the fitment as the piercing member is twisted about its longitudinal axis. This action will bring the sharp piercing tip 42 of the piercing member into engagement with the wall of the bag at the frangible zone to thereby penetrate through that zone like shown in FIG. 5, whereupon the liquid within the bag can flow out of the bag through the piercing member and into a dispensing tube connected to the tapering sidewall 44 of the piercing member.

In order to prevent leakage of the liquid out of the interface between the piercing member and the fitment once the piercing member has penetrated the wall of the bag, the apparatus 20 includes two sealing members or rings. In particular, as best seen in FIG. 8, the sidewall of the distally located section 40 of the piercing member includes a thin annular sealing ring 56 projecting radially outward from the outer surface of the piercing member. The outer diameter of the sealing ring 56 is slightly greater than the inner diameter of the fitment's central passageway 36 so that the sealing ring tightly engages the inner surface of the central passageway when the piercing member is inserted and screwed into it. In particular, the annular sealing ring 56 is located on the piercing member so that it will engage the inner surface of the central passageway 36 to form a compression seal before the piercing tip 42 engages the wall of the bag 10. By so doing, the apparatus 20 ensures that once the piercing tip reaches and pierces the wall of the bag, but before the piercing member is in its fully deployed state (where it is fully extended into the interior of the bag), no liquid within the bag will be able to gain egress or leak out of the interface between the inner surface of the fitment's passageway and the outer surface of the piercing member. A second, and somewhat wider, annular sealing ring 58 (FIG. 8) projects radially outward from the outer surface of the piercing member and is located slightly distally of the sealing ring 56. The sealing ring 58 is also of slightly larger outer diameter than the inner diameter of the central passageway 36 to tightly engage the tapering portion of the inner surface of the fitment's central passageway 36 when the piercing member has been fully deployed to its fully extended state, i.e., screwed fully into to fitment so that the piercing tip is fully within the interior of the bag. Thus, the sealing ring 58 forms a final, compression seal for the apparatus to prevent any liquid from leaking out of the interface between the between the inner surface of the fitment's passageway and the outer surface of the piercing member.

In order to hold the piercing member in its fully deployed state to thereby prevent it from backing out of the fitment, the piercing member 24 includes an annular locking ring 60 having a ramped or inclined outer surface. The locking ring 60 is located distally of the sealing ring 58 and includes a proximally facing end surface that serves as a stop. In particular, when the piercing member is inserted into the central passageway 36 and screwed therein the ramped surface of the locking ring 60 will be compressed slightly and will slide along the inner surface of the passageway 36 until it passes the rear face 28 of the fitment, whereupon the ring 60 will expand outward so that its stop surface 60 will engage the rear face of the fitment like shown in FIG. 8. At the same time, the flange 50 of the piercing member will engage the front face 34 of the fitment like shown in FIG. 7, thereby creating an interference fit to securely hold the piercing member in its fully deployed state and thereby prevent its removal.

In accordance with one preferred aspect of this invention a removable dust cover (not shown), in the form of an adhesive sticker, is adhesively secured on the front face 34 of the fitment, thereby sealing the proximal end of the fitment's passageway 36. Thus, with the fitment fixedly mounted on the outer surface of the wall 10A of the bag 10, the passageway 36 will be kept isolated from any dust or contaminants in the ambient surroundings by the removable cover, thereby ensuring that the interior of the passageway 36 is kept sanitary. When it is desired to dispense the liquid from the bag, all that is required is to remove (e.g., peel off) the removable cover and then insert the distal end of the piercing member into the proximal end of the passageway 36 so that the male screw threads 54 of the piercing member engage the female screw threads 52, whereupon twisting of the piercing member causes the piercing member to be screwed into its extended or deployed position. In that position the sharp tip portion 42 of the piercing member will have cut through the frangible zone of the bag's wall such that the tip and a contiguous portion of the piercing member will be located within the interior of the bag. Thus, the contents of the bag can then flow through and out of the fitment's passageway 48.

Turning now to FIGS. 10-21 another and more preferred embodiment of a dispensing apparatus 120 constructed in accordance with this invention is shown. The dispensing apparatus 120 is similar in general function to the apparatus 20 but different in construction. The apparatus 120 basically comprises a fitment 122 for securement to the wall of the bag or pouch in which the liquid to be dispensed is located, and a piercing member 124 having a piercing tip which is configured to be inserted and screwed into the fitment to pierce the wall of the bag or pouch to provide access to the liquid therein. The fitment 122, like the fitment 22, is preferred an injection molded integral plastic member made of a single thermoplastic, such as polyethylene that is able to be heat welded or ultrasonically welded to a flexible bag or container. The body includes a planar flange 126 having a planar rear surface 128 (FIG. 12) configured to be fixedly secured, e.g., welded, to the outer surface 14 of a portion of the wall 10A of the bag 10. The portion of the body contiguous with the flange 26 is in the form of a collar 130. A plurality of longitudinal extending ribs 130A are equidistantly spaced about the periphery of the collar 130 to enable the user of the dispensing apparatus 120 to tightly grasp the collar when the piercing member is inserted into the fitment and screwed therein, as will be described later. The distal end of the collar 130 includes a removable cover 132. A central passageway 136 extends through the collar from the cover 132 to the rear surface 128 of the flange 126. The cover 132 includes a ring 134 which is configured to be grasped and pulled by a user cause the ring and the cover to tear away from the collar 130 to expose the proximal end of the passageway 136. When the fitment 122 is secured to the front surface 14 of the wall 10A of the bag 10 a portion of the wall of the bag is in communication with the passageway 136. That portion of the wall 10A of the bag forms a frangible penetration zone 10B (FIG. 17) of the bag (i.e., the portion of the wall of the bag that will be penetrated by the piercing member 124, as will be described later).

The piercing member 124 is also an integrally molded unit preferably formed of the same plastic material as the fitment, but can be of other suitable materials. In any case the piercing member is a tubular member having a proximally located section 138 and a distally located section 140. The distal end of the distally located section 140 comprises a piercing tip that includes plural cutting teeth 142 extending a major portion of the periphery of the distal end of the distally located section 140. The teeth 142 will be described later. Suffice it for not to state that when the piercing member is inserted into the fitment and screwed into its deployed position, the teeth 142 pierce and cut the wall 10A of the bag or pouch at the frangible penetration zone 10B to create a flap opening thereat. The proximal end portion of the proximally located section 138 has a tapering sidewall 144 terminating at a generally planar proximal end face 146 (FIG. 15). The tapering sidewall 144 is provided to enable a dispensing tube (not shown) to be connected to it. The dispensing tube can form some portion of a dispensing device or can serve as the input to a receptacle or storage container into which the liquid from the bag 10 will flow when the piercing member is fully deployed.

As best seen in FIG. 15 a central passageway 148 extends the length of the piercing member 124 from its distally located end face 146 to the tips of the teeth 142. The passageway 148 includes a first section 148A and a second section 148B. The first section extends from the tips of the teeth 142 to a point beyond the mid-section of the piercing member. The second section 148B extends from the end face 146 to the proximal end of the first section 148A. The first and second sections may be of the same inside diameter or may be of different inside diameters, depending upon the desired flow rate through the apparatus 120. The exemplary embodiment of the fitment 122 makes use of a passageway whose first section 148A has an inside diameter, e.g., 0.590 inch, which is greater than the inside diameter, e.g., 0.310 inch of the second section. That configuration provides a dispensing apparatus which will dispense the liquid from the bag or pouch at a relatively low flow rate. As will be appreciated by those skilled in the art, if the piercing member 124 is molded such that its proximally located section 138 has a larger external diameter, the internal diameter of the second section 148B of the central passageway 148 can be increased to increase the flow rate provided by the apparatus 120.

Figure 10:
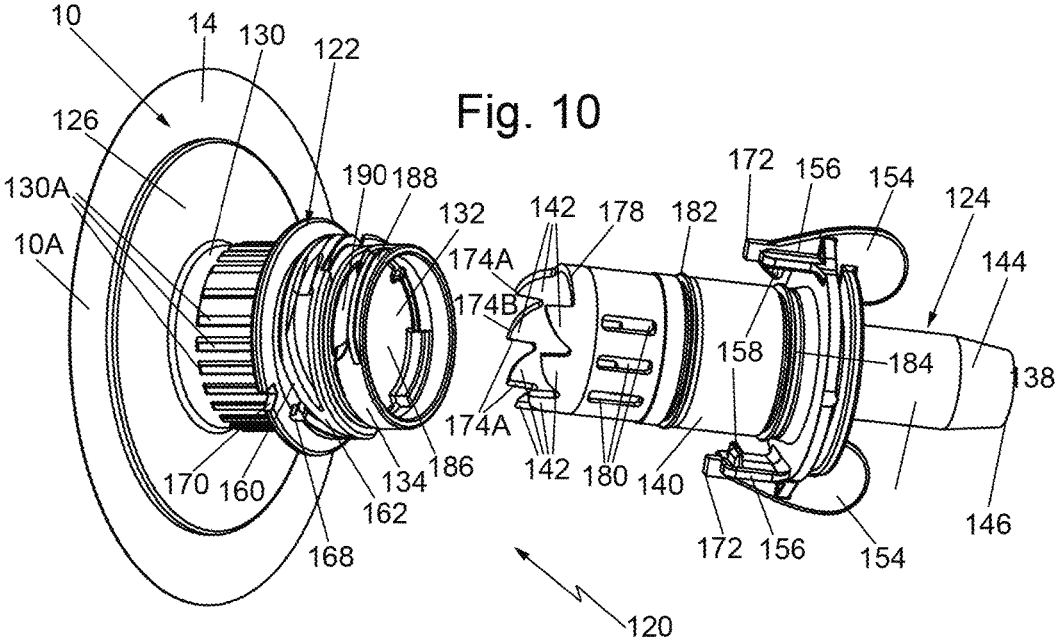
FIG. 10 is an exploded isometric view of another and more preferred exemplary dispensing apparatus, including a fitment and a piercing member, constructed in accordance with this invention for mounting on a flexible package having a liquid therein to dispense the liquid from the package, with the fitment including a removable protective cover.

A first annular flange 150 projects outward from the body of the piercing member 124 between the proximally located section 138 and the distally located section 140 at the location of the interface between the passageway sections 148A and 148B. A second annular flange 152 projects outward from the body of the piercing member 124 slightly distally of the flange 150. As best seen in FIG. 10, two generally planar finger tabs 154 are connected to the flanges 150 and 152 and project outward therefrom on diametrically opposed sides of the flanges. The tabs 154 serve as the portions of the piercing member 124 that are grasped by a user to screw the piercing member into the fitment. The two closely spaced flanges serve to reinforce the tabs to render the tabs resistant to flexing when the piercing member is screwed into the fitment. The distal portion of each of the tabs is in the form of an elongated finger 156. Each finger 156 extends parallel to the central longitudinal axis A (FIG. 15) of the piercing member. The inner surface of each finger 156 includes a short section 158 of a male helical thread. Each helical male thread section 158 projects radially inward toward the central longitudinal axis A of the piercing member so that the two thread sections 158 are diametrically opposed to each other. The two male thread sections 158 are configured to be received within respective ones of two diametrically opposed helical female thread sections 160 (FIGS. 10, 13A and 13B) on the collar 130 of the fitment to enable the piercing member to be screwed into the fitment. In particular, two helical female thread sections 160 are provided on the proximal end portion of the collar 130 as best seen in FIG. 13B. Each female thread section 160 includes an entrance 162 located at the proximal end of the collar 130. The distal end of each female thread section 160 terminates at a point 164 located adjacent an annular flange 166 projecting radially outward from the collar 130.

The male thread sections are configured to enter and slide along the female thread sections to screw the piercing member into the fitment, whereupon the teeth 142 of the piercing member will cut an opening in the frangible zone of the wall section 10A. That cutting operation will be described in detail later. Suffice it for now to state that when the piercing member is screwed into its fully extended or deployed state or position, the open distal end of the piercing member will be located within the interior 12 of the bag or pouch. Thus, the liquid in the bag can flow into the section 148A of the central passageway, from there it can flow into the section 148B and out the open end 146.

In order to hold the piercing member in its fully deployed state to thereby prevent it from backing out of the fitment, the dispensing apparatus includes a detent mechanism (to be described shortly). The detent mechanism also serves to ensure that the piercing cannot be reused after it has been fully deployed in the fitment. As will be seen from the description to follow the apparatus 120 is configured so that when its piercing member has been screwed to its fully extended (deployed) position, it will be locked in place thereat by the detent mechanism. By so doing the piercing member is precluded from being reused on another bag, since such a reuse could expose the liquid in the other bag to contamination by any contaminants on the reused piercing member.

The detent mechanism basically comprises a pair of thread locks 168 (FIGS. 10, 13A and 13B) that project outward from the fitment's collar 130 closely adjacent the points 164 at which the distal ends of the two female thread sections terminate, a pair of diametrically opposed notches 170 (FIG. 11) in the annular flange 166, and a pair of bosses 172 (FIGS. 10, 15 and 17) that project outward from the free end of the fingers 156. The notches 170 are configured to receive respective one of the bosses 172 when the piercing member is in its fully extended (deployed) state, i.e., has been fully screwed into the fitment. As best seen in FIG. 13B, the top or proximally facing surface of each of the thread locks 168 is in the form of a peaked cam surface 174. Each of the thread locks 168 is undercut by an angularly extending surface 176 located below the peaked cam surface 174.

Operation of the detent mechanism is as follows. The distal end of the piercing member is inserted into the proximal end of the central passageway 136 of the fitment by the user with the piercing member oriented so that its male thread sections 158 are axially aligned with the entrances 162 of respective female thread sections 160 of the fitment. The piercing member is then moved, e.g., pushed, distally so that the male thread sections enter the entrances of the aligned female thread sections. Once that has occurred, the user can screw the piercing member into the fitment to cause the teeth 14 of the piercing member to cut into the wall 10A of the bag at the frangible zone 10B. That screwing action is achieved by the user grasping the ribs 130A of the collar with one hand, while grasping the finger tabs 154 of the piercing member with the other hand to twist the piercing member with respect to the fitment in the clockwise direction. That twisting action causes the helical male thread sections 158 to slide along the helical female thread sections from the entrance of those sections until the leading edge of the male thread sections reach the peaked cam surfaces 174 of the thread locks 168. When that occurs, the male thread sections 158 slide along and ride up the up-sloped portions of the peaked cam surfaces 174 and then ride down the down-sloped portions of the peaked surfaces and flex somewhat until they reach the angularly extending undercut surfaces 176 of the thread locks, where they then snap into place. This action traps the male thread sections 158 at the locations 164 between the flange 166 and the undercut surfaces of the thread locks 168. At the same time that this occurs, the bosses 172 of the finger tabs 154 will have slid into their respective notches 170 in the flange 166 of the fitment precluding any further twisting of the piercing member with respect to the fitment. Those combined actions effectively lock the piercing member in its extended or deployed position.

Figure 16:
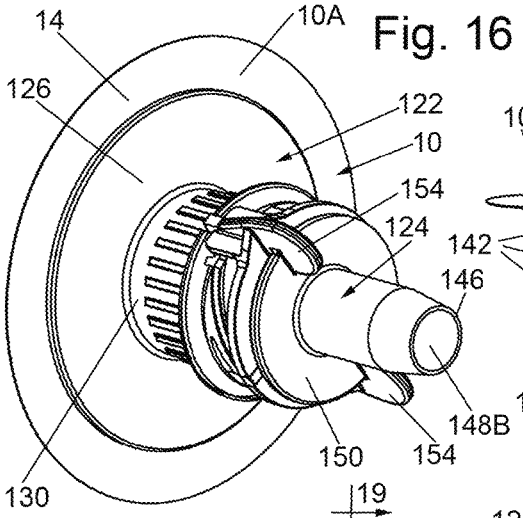
FIG. 16 is an isometric view showing the apparatus of FIG. 10 with its piercing member in its deployed position wherein it is fully inserted within the fitment with the distal end of the piercing member within the interior of the flexible package on which the fitment is mounted.

Turning now to FIGS. 10 and 16, it can be seen that the distal end of the piercing member includes seven teeth 142 equidistantly spaced about the periphery thereof, except for a gap 178 which is the width of two of the teeth 142. As best seen in FIG. 15, each of the teeth 142 includes a leading edge 178A and a trailing edge 178B. The leading edge 178A extends at a small acute angle to the central axis A. The trailing edge 178B is arcuate and extends from the point at which it merges with the tip of the tooth to the point that it merges with the root of the next successive tooth. The leading and trailing edges are sharp, such that when the tips of the teeth first engage the wall 10A at the frangible zone 10B, they will pierce therethrough. The twisting of the piercing member in the clockwise direction, with respect to the fitment causes the leading edge and the trailing edge to bite into and cut a circular line through the material making up the wall 10A of the bag. As should be appreciated by those skilled in the art, the shape of the teeth 142 ensures that the wall of the bag is cut readily with minimal twisting force applied. Moreover, since there is the gap 178 between the first and last tooth, the portion of the wall that is cut by the teeth will be an arc of less than 360 degrees, thereby creating a generally circular flap at the penetration zone 10B as shown in FIG. 16. That flap will remain connected to the wall of the bag by the uncut portion of the wall, thereby preventing it from becoming loose and possibly blocking the central passageway in the piercing member. In fact, the portion of the distal end of the piercing member that is within the interior 12 of the bag will act to hold the flap away from the open end of the piercing member so that the flap does not block or impede the flow of liquid into the central passageway of the piercing member. To ensure that the flap is held away from blocking the opening in the piercing member, the piercing member is dimensioned such that the tips of its teeth 142 are located a distance from the bag's wall 10A that is at least more than half of the outer diameter of the distal end of the piercing member. In the exemplary embodiment the distance between the tips of the teeth and the wall of the bag is 0.038 inch.

Figure 17:
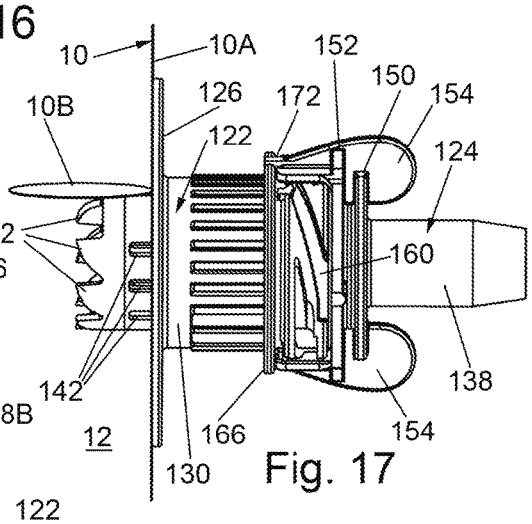
FIG. 17 is a side elevation view of apparatus with the piercing member shown in its deployed position.
Figure 18:
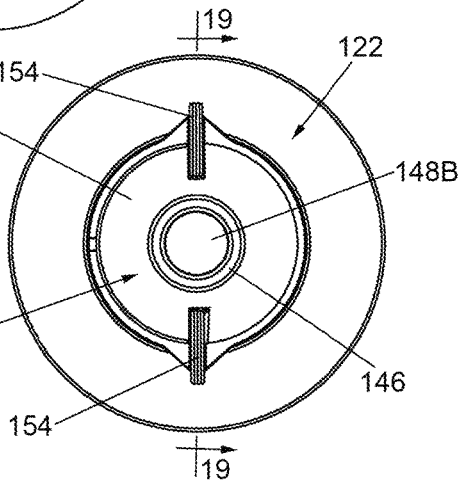
FIG. 18 is a front elevation view of the apparatus with the piercing member shown in its deployed position.

As best seen in FIGS. 10 and 17, the distal end portion of the piercing member includes a plurality of longitudinally extending windows or ports 180. Those ports extend through the sidewall of the piercing member so that they are in fluid communication with the central passageway section 148B. The ports enable one to dispense the entire liquid contents of the bag or pouch. In this regard, since the open distal end of the piercing member will be located some distance, e.g., 0.038 inch, from the wall 10B of the bag or pouch, if the bag or pouch is oriented so that the fitment and piercing member are facing downward, any liquid that would otherwise be trapped below the open end of the piercing member will flow into the ports and thus into the passageway 148B of the piercing member. Accordingly, irrespective of where the fitment is mounted on the wall of the bag, the entire liquid contents of the bag can be dispensed by merely orienting the bag so that the fitment and piercing member are directed downward, whereupon all of the liquid within the bag will flow into the fitment's central passageway, either through the open distal end of the piercing member or through the windows or ports 180.

Figure 20:
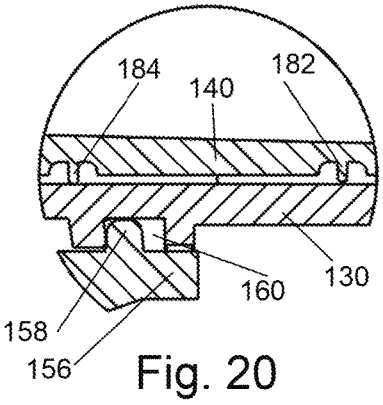
FIG. 20 is an enlarged sectional view of the portion of the apparatus shown within the area designated by the broken circle 20 in FIG. 19.
Figure 19:
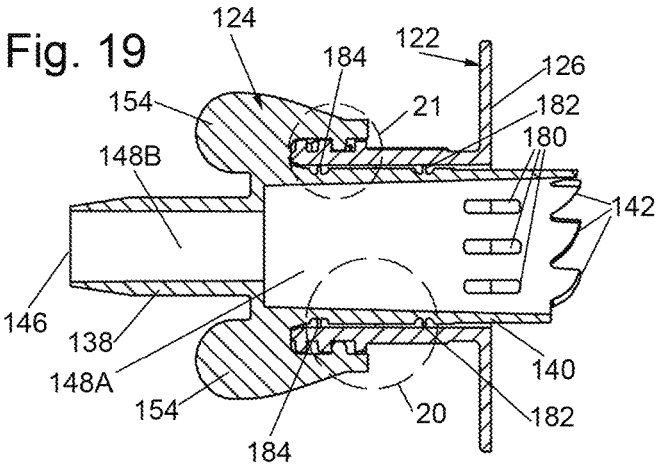
FIG. 19 is an enlarged sectional view taken along line 19-19 of FIG. 18.
Figure 21:
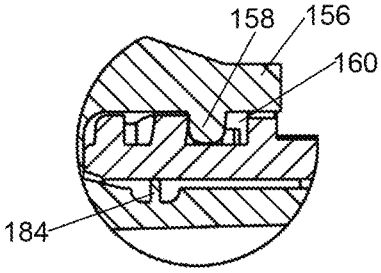
FIG. 21 is an enlarged sectional view of the portion of the apparatus shown within the area designated by the broken circle 21 in FIG. 19.

In order to prevent leakage of the liquid out of the interface between the piercing member 124 and the fitment 122 once the piercing member has penetrated the wall of the bag, the apparatus 120 includes two sealing members or rings. In particular, as best seen in FIGS. 10, 15 and 20, the sidewall of the distally located section 140 of the piercing member includes a thin annular sealing ring 182 projecting radially outward from an annular recess in the the outer surface of the piercing member. The outer diameter of the sealing ring 182 is slightly greater than the inner diameter of the fitment's central passageway 136 so that the sealing ring 182 tightly engages the inner surface of the central passageway when the piercing member is inserted and screwed into it. In particular, the annular sealing ring 182 is located on the piercing member so that it will engage the inner surface of the central passageway 136 to form a compression seal before the teeth 142 of the piercing member engage the wall 10A of the bag 10. By so doing, the apparatus 120 ensures that once the teeth reach and pierce the wall of the bag, but before the piercing member is in its fully extended (deployed) state, no liquid within the bag will be able to gain egress or leak out of the interface between the inner surface of the fitment's passageway and the outer surface of the piercing member. A second thin annular sealing ring 184 projects radially outward from an annular recess in the outer surface of the piercing member. The ring 184 is located proximally of the sealing ring 182. The sealing ring 184 is of slightly larger outer diameter than the sealing ring 182 so that it will tightly engage the inner surface of the fitment's central passageway 36 when the piercing member has been fully deployed to its fully deployed state, i.e., screwed fully into to fitment so that the piercing tip is fully within the interior of the bag. Thus, the sealing ring 184 forms a final, compression seal for the apparatus to prevent any liquid from leaking out of the interface between the between the inner surface of the fitment's passageway and the outer surface of the piercing member.

Figure 11:
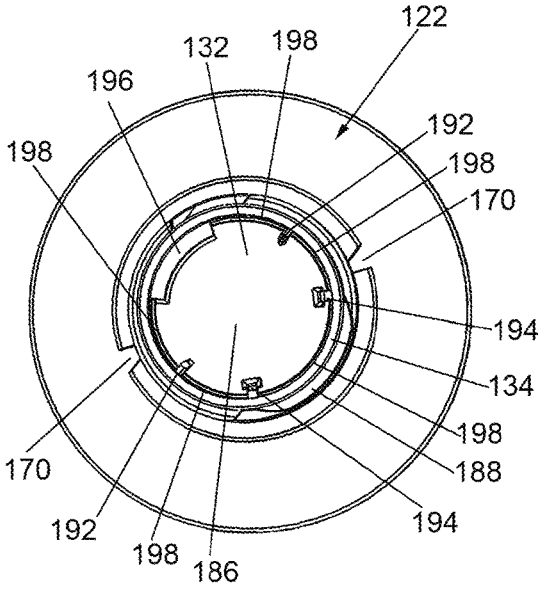
FIG. 11 is a front elevation view of the fitment shown in FIG. 10.
Figure 12:
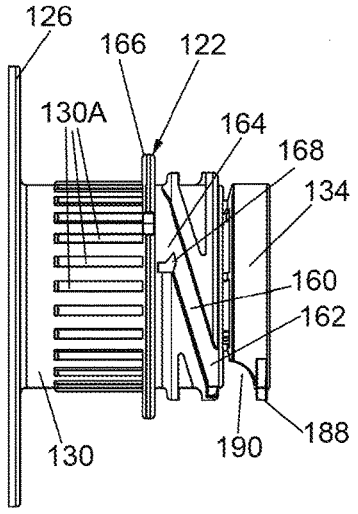
FIG. 12 is a side elevation view of the fitment shown in FIG. 11.

Turning now to FIGS. 10-12, the details of the removable cover 132 will now be described. To that end, as can be seen the cover 132 basically comprises a thin circular wall or disk 186 located within the heretofore identified ring 134. The sidewall of the ring includes a flange-like tab 188 projecting outward adjacent the top edge of the ring. A somewhat crescent shaped opening 190 is located in the sidewall of the ring below the tab 188. A pair of narrow connectors 192 is connected between the inner surface of the ring 134 and the top surface of the disk 186. A pair of wider connectors 194 is connected between the inner surface of the ring 134 and the top surface of the disk 186 and is located between the connectors 192. A very wide arcuate connector 196 is connected between the inner surface of the ring 134 and the top surface of the disk 186 between the connectors 192 and generally opposite the connectors 194. The top surface of the disk 186 of the cover at the interface with the ring 134 and located between the connectors 192, 194 and 196 is in the form of arcuate sections 198 of a groove, whereupon the thickness of the disk under the groove is very thin, e.g., 0.007 inch. Moreover, the undersurface of the disk 186 at the locations of the connectors 192, 194 and 196 is in the form of arcuate sections of a groove (not shown). The depth of the sections of that groove is equal to the thickness of the disk 186 minus the thickness of the groove sections 198. Thus, the groove sections 198 in the top of the disk 186 and the groove sections in the underside of the disk conjoin to form a circular frangible tear line extending about the periphery of the disk. The tear line is generally flush with the inner surface of the central passageway 136 of the fitment's collar.

The cover 130 is configured to be torn away from the collar by the breaking of the frangible tear line. To that end, the tab 188 is arranged to be grasped by the user extending either his/her thumb or index finger into the opening 190 to engage the undersurface of the tab 188, while his/her index finger or thumb (as the case may be) engages the upper surface of the tab. The user then pulls upward on the tab, whereupon the ring 134 and the disk 186 break away from the collar, leaving the fitment secured to the bag in the condition shown in FIG. 13A, i.e., with the proximal end of the central passageway open and ready for receipt of the piercing member.

Figure 22:
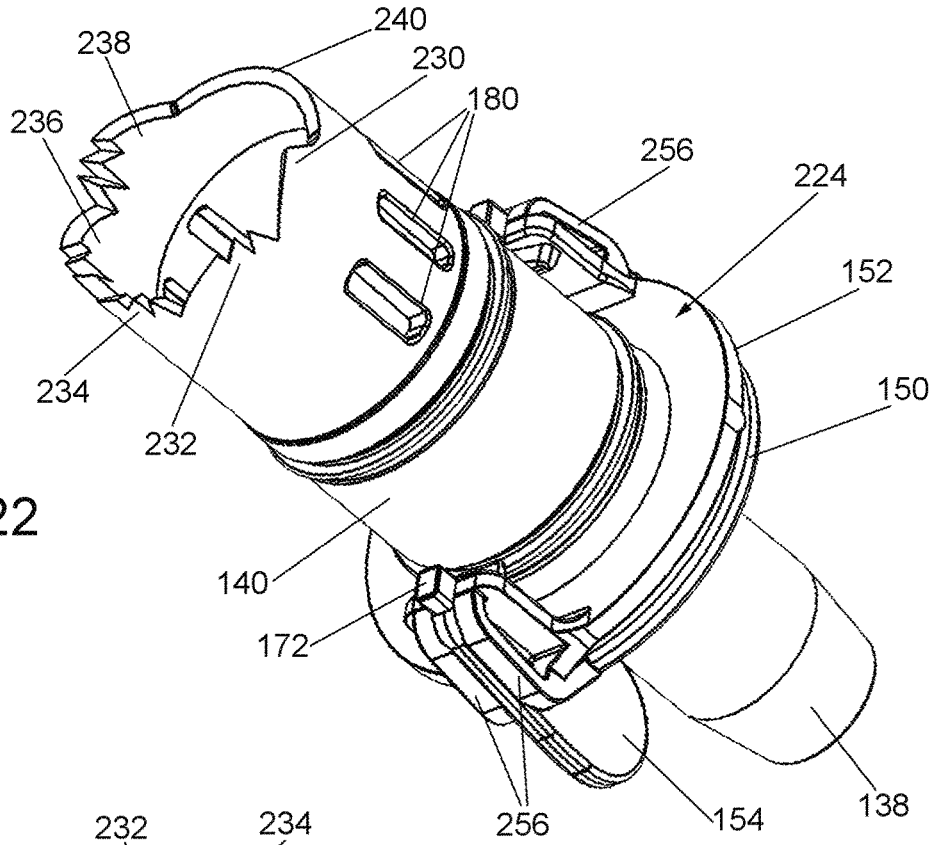
FIG. 22 is an isometric view of a preferred alternative piercing member forming a portion of the dispensing apparatus shown in FIG. 10.
Figure 23:
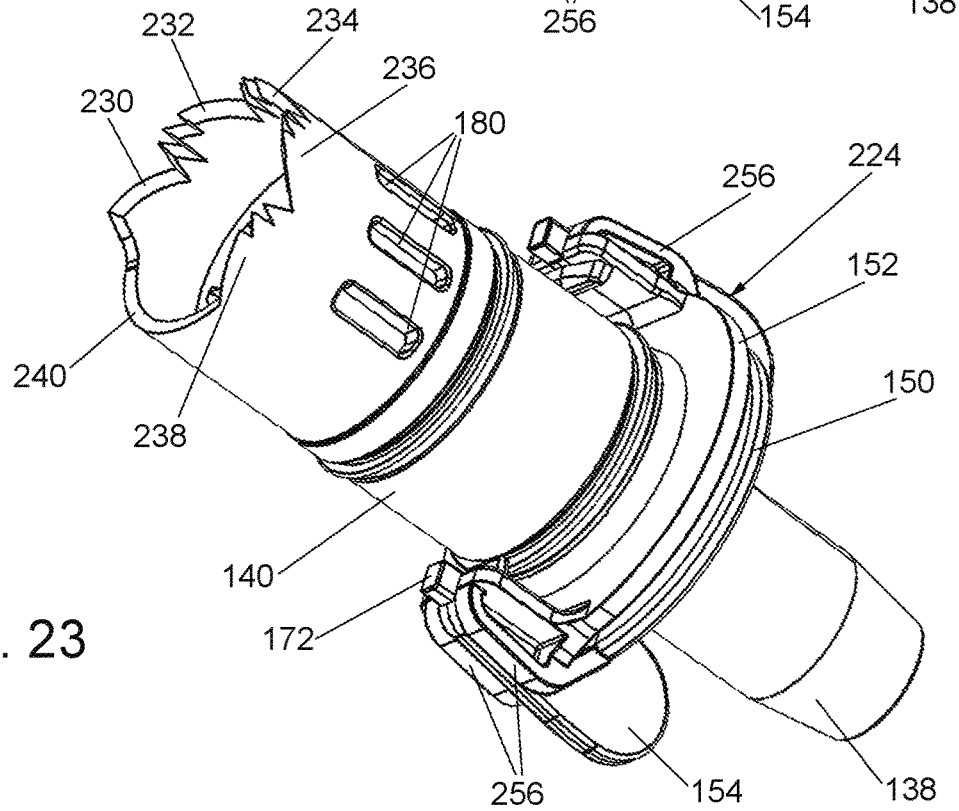
FIG. 23 is an isometric view of the preferred alternative piercing member shown in FIG. 22, but taken from a different angle.

Turning now to FIGS. 22 and 23 there is shown an alternative and most preferred piercing member 224 for use with the fitment 122 to result in a most preferred dispensing apparatus. The piercing member 224 is constructed similarly to the piercing member 124 except for the construction of the piercing tip and the finger tabs. Thus, in the interest of brevity the components of the piercing member 224 which are common with the components of the piercing member 124 will be given the same reference numbers and the details of their construction, arrangement and operation will not be reiterated.

The distal end of the distally located section 140 of the piercing member 224 comprises a piercing tip that includes plural cutting teeth extending along a major portion of the periphery or circumference of the distal end of the distally located section 140. In the exemplary embodiment shown there are five teeth, namely, a leading tooth 230, followed by four successive trailing teeth 232, 234, 236, and 238. The five teeth 230-238 extend about the periphery of the distally located section except for a gap 240 which is located between the leading tooth 230 and the last trailing tooth 238. In the exemplary embodiment shown each of the teeth 230-238 extends for the same portion of the circumference, e.g., approximately 58 degrees, of the distally located section, whereas the gap 240 extends for approximately 70 degrees of the circumference of the distally located section. The trailing teeth 232-238 are shaped and constructed to cut more aggressively than the leading tooth 230, as will be described later.

Figure 24A:
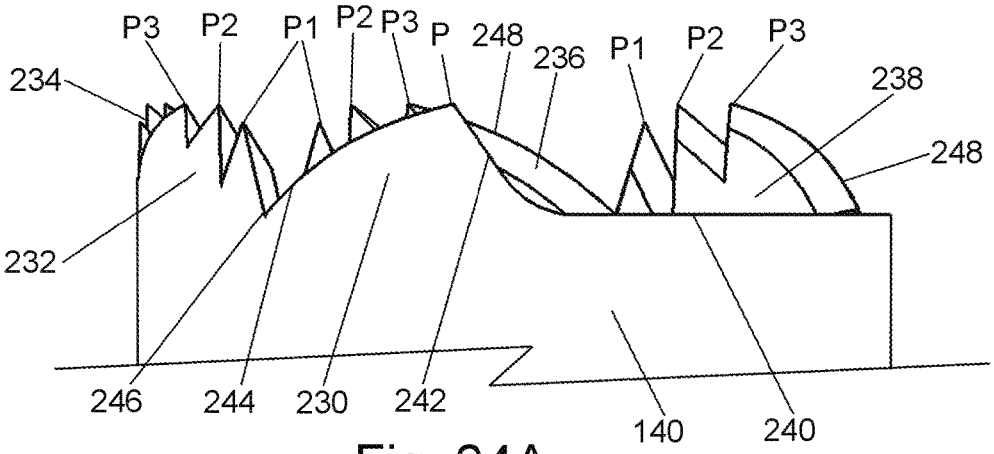
FIG. 24A is an enlarged side elevation view showing the cutting teeth forming of the alternative piercer member of FIGS. 22 and 23 taken from one direction.

As best seen in FIG. 24A the leading tooth 230 includes a leading edge 242 and a trailing edge 244. The leading edge 242 is generally linear except for a concave arcuate portion where it merges with the trailing end of the gap 240. The trailing edge 244 of the leading tooth 230 is longer in length, i.e., takes up more of the periphery of the distally located section, than the leading edge and is of arcuate convex shape. The trailing edge 244 terminates at the root 246 of the leading edge of the first trailing tooth 232.

Figure 24B:
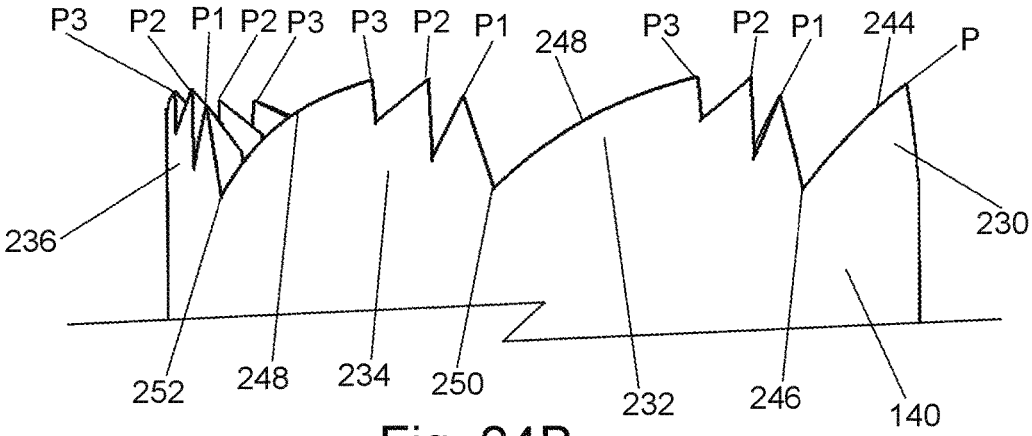
FIG. 24B is another enlarged side elevation view showing the cutting teeth forming of the alternative piercer member of FIGS. 22 and 23, but taken from another and different direction.
Figure 24C:
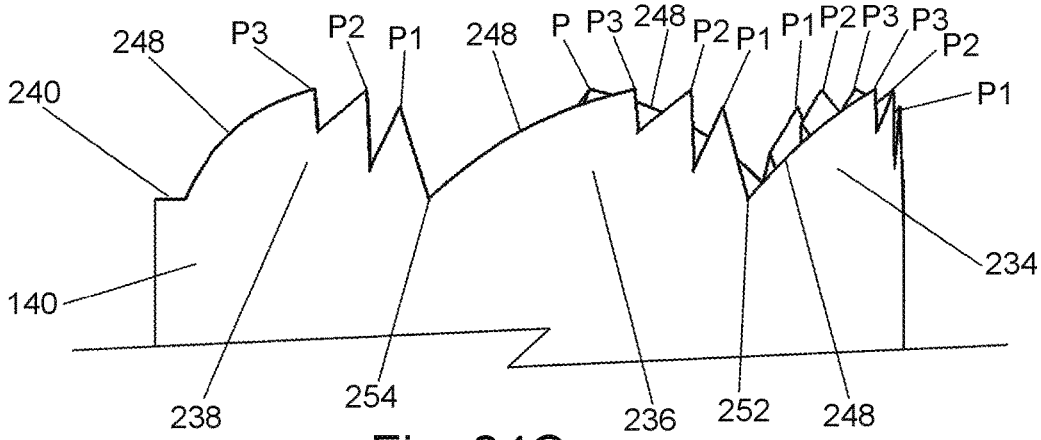
FIG. 24C is still another enlarged side elevation view showing the cutting teeth forming of the alternative piercer member of FIGS. 22 and 23, but taken from still another and different direction.

All of the trailing teeth are identical and of a serrated construction. In particular, each trailing tooth includes a first or leading point P1, a second or middle point P2, and a third or trailing point P3. The second or middle point P2 of all of the trailing teeth are of the same height as the point P of the leading tooth 230, so that all of the teeth 230-238 engage the wall 10A of the bag or pouch at the same time when the piercing member 224 is initially brought into engagement with the wall of the bag to pierce it. As best seen in FIG. 24B the trailing edge 248 of the first trailing tooth 232 is of arcuate convex shape and is slightly shorter in length than the trailing edge 244 of the leading tooth 230. The trailing edge 248 of the first trailing tooth 232 terminates at a root 250 at the leading edge of the second trailing tooth 234. The trailing edge 248 of the second trailing tooth 234 terminates at a root 252 at the leading edge of the third trailing tooth 236. As best seen in FIG. 24C the trailing edge 248 of the third trailing tooth 236 terminates at a root 254 at the leading edge of the fourth trailing tooth 238. The trailing edge 248 of the fourth trailing tooth 238 terminates at the leading end of the gap 240.

The piercing member 224 is designed like the piercing member 124 so that when the piercing member 224 is used it is pushed through the passageway 136 of the fitment 122 to engage and initially puncture the wall 10A of the bag or pouch at the penetration zone 10B to pierce therethrough. After that has occurred the piercing member 224 is twisted in the clockwise direction to screw it deeper into the passageway 136, whereupon the point P1 of the leading tooth 230 and the second (middle) points P2 of all of the trailing teeth 232, 234, 236 and 238 will pierce the wall of the bag at the same time, since they all are of the same height. This action starts the propagation of a cut in the material, e.g., film, making up the wall of the bag from each point as it pierces the portion of the wall of the bag at the location of that point. In particular, the point P of the leading tooth 230 pierces a portion of the wall 10A to produce a cut therein at the location of the point P, which cut propagates linearly in the forward (clockwise) direction and rearward (counterclockwise) direction. At the same time that the point P of the leading tooth 230 pierces the wall 10A, the second (middle) points P2 of each of the trailing teeth 232, 234, 236 and 238 pierce the wall 10A at their respective locations to produce a series of sequential spaced apart cuts. Each of those spaced cuts propagates linearly from the second point P2 of the particular trailing tooth forward toward the first point P1 of that tooth and backward towards the third point P3 of that tooth. Once the piercing member has been screwed into the passageway 126 so that first and third points, P1 and P3, respectively, of each of the trailing teeth engage the wall 10A they pierce the wall at their respective locations to extend the length of each of the cuts of the series of sequential cuts. Upon further screwing of the piercing member into the fitment the sequential cuts produced by the trailing teeth 232-238 will continue to propagate in the forward direction and rearward direction until those sequential cuts merge together with the cut produced by the leading tooth 230. That action forms a continuous circular cut of less than 360 degrees, thereby creating the generally circular flap at the penetration zone 10B like shown in FIG. 16. In particular, since the leading edge 242 of the leading tooth 230 terminates at the gap 240, the cut in the wall 10A produced by that leading edge will propagate in the forward direction as the piercing member is screwed deeper into the fitment until the cut reaches the gap, whereupon it will stop propagating in that direction. Moreover, when that cut reaches the gap the flap produced will be lifted so that the flap is out of the way, thereby preventing the flap from becoming loose and possibly blocking the central passageway 148 in the piercing member 224.

It should be pointed out at this juncture, that while not mandatory, it is desirable that the trailing edge of each of the trailing teeth be somewhat elongated to keep the number of teeth of the piercing tip to a minimum but enabling the piercing tip to make a clean, effective cut quickly and easily. As will be appreciated by those skilled in the art, by keeping the number of teeth to a minimum the pushing force necessary to initially pierce the wall 10A is kept relatively low. It has been found that using one leading tooth and four trailing teeth (for a total of five equal-width teeth) the piercing member 224 provides an optimal combination of a relatively low pushing force to initially pierce the material making up the wall of the bag or pouch, while enabling the teeth to easily and cleanly cut that material as the piercing member is screwed into the fitment.

As mentioned earlier the leading tooth 230 is less aggressive in its cutting action than the trailing teeth 232-238. This is a result of the fact that leading edge 242 of the leading tooth extends a shallower angle to an axis extending parallel to the central longitudinal axis A than the more steep leading edge of each of the trailing teeth 232-238. Moreover, the leading tooth only includes one point P, whereas the trailing teeth each are serrated to include three sharp piercing points P1, P2, and P3. Making the leading tooth less aggressive reduces the possibility of completely severing the flap from the bag or pouch.

It must be pointed out at this juncture that the construction of the piercing tip of the piercing member 224 as described above, while preferred, is not mandatory. Thus, other piercing tips with fewer or greater number of teeth may be constructed in accordance with this invention. Moreover, if desired the leading tooth may be serrated to include one or more points. Further still, the trailing teeth may be constructed so that if they are serrated they have less than three points or more than three points.

As mentioned above the piercing member 224 differs from the piercing member 124 in that the finger tabs for effecting the twisting (screwing) of the piercing member into the fitment are different. In particular, as can be seen in FIGS. 22 and 23 each of the tabs 154 includes a rib 256 to strengthen or reinforce those tabs. This reinforcement may be necessary if the apparatus is used to dispense hot products, e.g., melted cheese sauce, since the heat, e.g., 140-160 degrees, of such products could cause the flexing or deformation of the piercing member, which could impede its operation.

As will be appreciated by those skilled in the art from the foregoing, the apparatus of this invention makes use of the mating threads the fitment and the piercing member to provide a mechanical advantage in deploying the piercing member through the throat of the fitment to pierce the wall of the flexible bag. That mechanical advantage allows for typical hand force application to the piercing member in a twisting manner to penetrate bags or containers made of flexible films of much higher durability and puncture resistance than previously deemed possible without significant effort. The subject invention also allows for forward placement of the sealing ring on the outer circumference of the piercing member to ensure fluid-tight sealing of the assembly before, during and after piercing the container to permit fluid flow.

While the invention has been described in detail and with reference to specific examples thereof, it will be apparent to one skilled in the art that various changes and modifications can be made therein without departing from the spirit and scope thereof.

I claim:

1. Apparatus for dispensing a liquid from within a flexible package, said apparatus comprising:

a fitment comprising a body having a passageway extending therethrough, and a flange, said passageway having a central longitudinal axis, said flange being configured for securement to a wall of the flexible package, whereupon a portion of the wall of the flexible package is located within said passageway; and a piercing member comprising a distally located section, a proximally located section, and a passageway extending through said distally located section and said proximally located section, said piercing member having a piercing tip configured to be rotated in a first rotation direction about said central longitudinal axis, said piercing tip comprising a leading tooth and a plurality of trailing teeth, said leading tooth having a piercing point and a leading edge contiguous with said piercing point extending at an angle to an axis parallel to said central longitudinal axis, each of said plurality of trailing teeth having a piercing point and a leading edge contiguous with the piercing point thereof, said leading edge of each of said trailing teeth extending at an angle to an axis parallel to said central longitudinal axis, said angle of said leading tooth being shallower than said angle of said trailing teeth, said leading tooth being configured to engage a portion of the wall of the package upon rotation of said piercing member about said central longitudinal axis in said first rotational direction to cut and pierce therethrough at the same time that said plurality of trailing teeth engage respective portions of the wall of the package to cut and pierce therethrough, whereupon said piercing tip penetrates through the wall of the package to enable the liquid within the package to flow into and through said passageway of said piercing member.

2. The apparatus of claim 1, wherein said plurality of trailing teeth comprises a series of a first trailing tooth and a last trailing tooth, and wherein said piercing tip additionally comprises a gap between said leading tooth and said last trailing tooth, whereupon when said piercing member penetrates the wall of the package it creates a flap which remains connected to the wall of the package.

3. The apparatus of claim 1, wherein each of said plurality of trailing teeth is of identical construction.

4. The apparatus of claim 1, wherein when said piercing member is located within said passageway of said fitment an interface is created therebetween and wherein said apparatus additionally comprises a first sealing member and a second sealing member for sealing said interface.

5. The apparatus of claim 4, wherein said first sealing member is configured to form a compression seal before said piercing tip penetrates the wall of the package and said second sealing member is configured to form a compression seal in said interface after said piercing tip has penetrated the wall of the package.

6. Apparatus for dispensing a liquid from within a flexible package, said apparatus comprising:

a fitment comprising a body having a passageway extending therethrough, and a flange, said passageway having a central longitudinal axis, said flange being configured for securement to a wall of the flexible package, whereupon a portion of the wall of the flexible package is located within said passageway; and a piercing member comprising a distally located section, a proximally located section, and a passageway extending through said distally located section and said proximally located section, said piercing member having a piercing tip configured to be rotated in a first rotation direction about said central longitudinal axis, said piercing tip comprising a leading tooth and a plurality of trailing teeth, said plurality of trailing teeth being of identical construction and comprising a series of a first trailing tooth and a last trailing tooth, and wherein each of said trailing teeth is serrated and comprises a series of a first piercing point, a second piercing point and a third piercing point, said second piercing point being located between said first and third piercing points, and wherein all of said piercing points of said trailing teeth are of the same height and wherein said piercing tip additionally comprises a gap between said leading tooth and said last trailing tooth, wherein said leading tooth includes a piercing point and a leading edge extending at an angle to an axis extending parallel to said central longitudinal axis, each of said plurality of trailing teeth having a leading edge extending at an angle parallel to said central longitudinal axis, said angle of said leading tooth being shallower than said angle of said trailing teeth, said leading tooth being configured to engage a portion of the wall of the package upon rotation of said piercing member about said central longitudinal axis in said first rotational direction to cut and pierce therethrough at the same time that said plurality of trailing teeth engage respective portions of the wall of the package to cut and pierce therethrough, whereupon said piercing tip penetrates through the wall of the package to enable the liquid within the package to flow into and through said passageway of said piercing member and to create a flap which remains connected to the wall of the package.

7. The apparatus of claim 6 wherein said leading tooth includes a generally linear leading edge and a convex arcuate trailing edge, and wherein said piercing point of said leading tooth is located between said generally linear leading edge and said convex arcuate trailing edge.

8. The apparatus of claim 7, wherein each of said trailing teeth comprise a generally linear leading edge and an elongated arcuate trailing edge.

9. The apparatus of claim 8, wherein said piercing tip has a predetermined periphery, and wherein each of said teeth extends for a respective portion of said predetermined periphery, each of said respective portions being the same.

10. The apparatus of claim 9, wherein said plurality of trailing teeth consists of four trailing teeth and wherein said gap extends for approximately 70 degrees along said predetermined periphery measured about said central longitudinal axis.

11. A flexible package configured for dispensing a liquid therefrom, said flexible package comprising;

a hollow member having a wall formed of a flexible material; and a dispensing apparatus for dispensing a liquid from within said flexible package, said dispensing apparatus comprising:

a fitment comprising a body having a passageway extending therethrough, and a flange, said passageway having a central longitudinal axis, said flange being configured for securement to a wall of the flexible package, whereupon a portion of the wall of the flexible package is located within said passageway; and a piercing member comprising a distally located section, a proximally located section, and a passageway extending through said distally located section and said proximally located section, said piercing member having a piercing tip configured to be rotated in a first rotation direction about said central longitudinal axis, said piercing tip comprising a leading tooth and a plurality of trailing teeth, said leading tooth having a piercing point and a leading edge contiguous with said piercing point extending at an angle to an axis parallel to said central longitudinal axis, each of said plurality of trailing teeth having a piercing point and a leading edge contiguous with the piercing point thereof, said leading edge of each of said trailing teeth extending at an angle to an axis parallel to said central longitudinal axis, said angle of said leading tooth being shallower than said angle of said trailing teeth, said leading tooth being configured to engage a portion of the wall of the package upon rotation of said piercing member about said central longitudinal axis in said first rotational direction to cut and pierce therethrough at the same time that said plurality of trailing teeth engage respective portions of the wall of the package to cut and pierce therethrough, whereupon said piercing tip penetrates through the wall of the package to enable the liquid within the package to flow into and through said passageway of said piercing member.

12. The flexible package of claim 11, wherein said plurality of trailing teeth comprises a series of a first trailing tooth and a last trailing tooth, and wherein said piercing tip additionally comprises a gap between said leading tooth and said last trailing tooth, whereupon when said piercing member penetrates the wall of the package it creates a flap which remains connected to the wall of the package.

13. The flexible package of claim 11, wherein each of said plurality of trailing teeth is of identical construction.

14. The flexible package of claim 11, wherein when said piercing member is located within said passageway of said fitment an interface is created there between and wherein said apparatus additionally comprises a first sealing member and a second sealing member for sealing said interface.

15. The flexible package of claim 14, wherein said first sealing member is configured to form a compression seal before said piercing tip penetrates the wall of the package and said second sealing member is configured to form a compression seal in said interface after said piercing tip has penetrated the wall of the package.

16. A flexible package configured for dispensing a liquid therefrom, said flexible package comprising;

a hollow member having a wall formed of a flexible material; and a dispensing apparatus for dispensing a liquid from within said flexible package, said dispensing apparatus comprising:

a fitment comprising a body having a passageway extending therethrough, and a flange, said passageway having a central longitudinal axis, said flange being configured for securement to a wall of the flexible package, whereupon a portion of the wall of the flexible package is located within said passageway; and a piercing member comprising a distally located section, a proximally located section, and a passageway extending through said distally located section and said proximally located section, said piercing member having a piercing tip configured to be rotated in a first rotation direction about said central longitudinal axis, said piercing tip comprising a leading tooth and a plurality of trailing teeth, said plurality of trailing teeth being of identical construction and comprising a series of a first trailing tooth and a last trailing tooth, and wherein each of said trailing teeth is serrated and comprises a series of a first piercing point, a second piercing point and a third piercing point, said second piercing point being located between said first and third piercing points, and wherein all of said piercing points of said trailing teeth are of the same height and wherein said piercing tip additionally comprises a gap between said leading tooth and said last trailing tooth, wherein said leading tooth includes a piercing point and a leading edge extending at an angle to an axis extending parallel to said central longitudinal axis, each of said plurality of trailing teeth having a leading edge extending at an angle parallel to said central longitudinal axis, said angle of said leading tooth being shallower than said angle of said trailing teeth, said leading tooth being configured to engage a portion of the wall of the package upon rotation of said piercing member about said central longitudinal axis in said first rotational direction to cut and pierce therethrough at the same time that said plurality of trailing teeth engage respective portions of the wall of the package to cut and pierce therethrough, whereupon said piercing tip penetrates through the wall of the package to enable the liquid within the package to flow into and through said passageway of said piercing member and to create a flap which remains connected to the wall of the package.

17. The flexible package of claim 16 wherein said leading tooth includes a generally linear leading edge and a convex arcuate trailing edge, and wherein said piercing point of said leading tooth is located between said generally linear leading edge and said convex arcuate trailing edge.

18. The flexible package of claim 17, wherein said leading tooth includes an arcuate leading cutting edge and an arcuate trailing cutting edge.

19. The flexible package of claim 18, wherein said piercing tip has a predetermined periphery, and wherein each of said teeth extends for a respective portion of said predetermined, each of said respective portions being the same.

20. The flexible package of claim 19, wherein said plurality of trailing teeth consists of four trailing teeth and wherein said gap extends for approximately 70 degrees along said predetermined periphery measured about said central longitudinal axis.

* * * * *